US008385587B2

(12) United States Patent
Debaes

(10) Patent No.: US 8,385,587 B2
(45) Date of Patent: Feb. 26, 2013

(54) METHOD TO AVOID MIXED CONTOURS IN PILE FABRICS

(75) Inventor: Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 1470 days.

(21) Appl. No.: 11/653,198

(22) Filed: Jan. 12, 2007

(65) Prior Publication Data

US 2008/0170757 A1 Jul. 17, 2008

(30) Foreign Application Priority Data

Jan. 13, 2006 (BE) ..... 2006/0032

(51) Int. Cl.
*G06K 9/00* (2006.01)

(52) U.S. Cl. ..... 382/100

(58) Field of Classification Search ..... 382/111, 382/141, 152; 139/59, 60, 61, 62, 63, 64, 139/65, 68, 85, 86, 165, 317, 332, 335, 1 B, 139/2, 318, 319, 397, 418, 452, 453; 66/231–242; 700/109, 110, 130–143; 28/184, 214; 112/4, 112/84, 470.01, 470.04, 470.05
See application file for complete search history.

(56) References Cited

U.S. PATENT DOCUMENTS 1,753,343 A * 4/1930 Hug ..... 66/238
2,058,101 A * 10/1936 Perry ..... 139/319
3,253,462 A * 5/1966 Wiesinger ..... 73/156
3,529,298 A * 9/1970 Lourie ..... 700/131
3,671,944 A * 6/1972 Dubner ..... 700/131
3,710,020 A * 1/1973 Levin et al. ..... 358/501
3,719,803 A * 3/1973 Frappe ..... 235/474
3,722,434 A * 3/1973 Strother et al. ..... 112/80.23
3,741,468 A * 6/1973 Servillat ..... 234/65
3,786,987 A * 1/1974 Nishikawa et al. ..... 234/2
4,004,135 A * 1/1977 Maurer et al. ..... 235/434
4,018,064 A * 4/1977 Doslik ..... 66/232
4,078,253 A * 3/1978 Kajiura et al. ..... 700/131
4,085,597 A * 4/1978 Kamikura et al. ..... 66/75.2
4,120,045 A * 10/1978 Moellgaard et al. ..... 700/131
4,221,176 A * 9/1980 Besore et al. ..... 112/102.5
4,346,366 A * 8/1982 Kajiura et al. ..... 700/141
4,469,037 A * 9/1984 Bost, Jr. ..... 112/475.19
4,479,368 A * 10/1984 Gloeckler ..... 66/75.2
4,608,642 A * 8/1986 Shima ..... 700/141
4,756,340 A * 7/1988 Janssen ..... 139/397
4,841,748 A * 6/1989 Watanabe et al. ..... 66/218
4,856,104 A * 8/1989 Stoll et al. ..... 700/141
5,058,174 A * 10/1991 Carroll ..... 382/111
5,200,904 A * 4/1993 Tottman ..... 700/131

(Continued)

FOREIGN PATENT DOCUMENTS

EP 534515 A1 * 3/1993
EP 612874 A1 * 8/1994

(Continued)

*Primary Examiner* — Vikkram Bali
(74) *Attorney, Agent, or Firm* — James Creighton Wray

(57) ABSTRACT

A computer reviews card designs for color changes in a fabric pattern that might cause mixed contours in the fabric woven by a Jacquard design. The computer displays problem positions of the card designs that cannot be corrected by correction lift plans and suggests changes to the card designs. When permitted the computer automatically changes the card designs to avoid mixed contours.

27 Claims, 4 Drawing Sheets

U.S. PATENT DOCUMENTS

| | | | | |
|---|---|---|---|---|
| 5,388,050 | A * | 2/1995 | Inoue et al. | 700/131 |
| 5,398,730 | A | 3/1995 | Derudder et al. | 139/21 |
| 5,400,831 | A * | 3/1995 | Gheysen | 139/21 |
| 5,404,917 | A * | 4/1995 | Gheysen | 139/398 |
| 5,447,182 | A * | 9/1995 | Gehrig | 139/396 |
| 5,465,761 | A * | 11/1995 | Gheysen | 139/21 |
| 5,655,573 | A * | 8/1997 | Gheysen et al. | 139/21 |
| 5,749,400 | A * | 5/1998 | Pascual | 139/421 |
| 5,829,487 | A * | 11/1998 | Thomas et al. | 139/319 |
| 6,073,663 | A * | 6/2000 | Dewispelaere | 139/455 |
| 6,082,412 | A * | 7/2000 | Wildeman et al. | 139/1 R |
| 6,085,803 | A * | 7/2000 | Dewispelaere | 139/455 |
| 6,095,198 | A * | 8/2000 | Debaes | 139/398 |
| 6,102,083 | A * | 8/2000 | Vandoorne | 139/391 |
| 6,181,816 | B1 * | 1/2001 | Adams et al. | 382/162 |
| 6,182,708 | B1 * | 2/2001 | Smissaert | 139/21 |
| 6,185,475 | B1 * | 2/2001 | Chung | 700/131 |
| 6,282,329 | B1 * | 8/2001 | Ikeda | 382/309 |
| 6,304,793 | B1 * | 10/2001 | Komiya et al. | 700/138 |
| 6,336,475 | B2 * | 1/2002 | Dewispelaere et al. | 139/391 |
| 6,356,648 | B1 * | 3/2002 | Taguchi | 382/111 |
| 6,390,143 | B1 * | 5/2002 | Speich | 139/1 R |
| 6,457,489 | B2 * | 10/2002 | Smissaert | 139/21 |
| 6,611,730 | B1 * | 8/2003 | Stoll et al. | 700/131 |
| 6,748,290 | B2 * | 6/2004 | Somaia | 700/140 |
| 6,804,573 | B2 * | 10/2004 | Goldman | 700/138 |
| 6,857,294 | B2 * | 2/2005 | Okamoto | 66/64 |
| RE38,718 | E * | 3/2005 | Futamura | 700/138 |
| 6,994,120 | B2 * | 2/2006 | Speich | 139/1 R |
| 7,110,847 | B2 * | 9/2006 | Ostyn | 700/140 |
| 7,272,244 | B2 * | 9/2007 | Saporiti et al. | 382/111 |
| 7,330,772 | B2 * | 2/2008 | Suzuki | 700/139 |
| 7,395,839 | B2 * | 7/2008 | Debaes | 139/21 |
| 7,520,303 | B2 * | 4/2009 | Mertens et al. | 139/21 |
| 7,634,326 | B2 * | 12/2009 | Christman et al. | 700/131 |
| 2001/0010236 | A1 * | 8/2001 | Dewispelaere et al. | 139/391 |
| 2001/0012381 | A1 * | 8/2001 | Sari-Sarraf et al. | 382/111 |
| 2001/0039975 | A1 * | 11/2001 | Braun | 139/59 |
| 2003/0091214 | A1 * | 5/2003 | Gould | 382/111 |
| 2003/0187538 | A1 * | 10/2003 | Somaia | 700/140 |
| 2004/0015257 | A1 * | 1/2004 | Bailie | 700/138 |
| 2004/0049310 | A1 * | 3/2004 | Morimoto et al. | 700/140 |
| 2005/0115285 | A1 * | 6/2005 | Xu et al. | 66/231 |
| 2007/0006932 | A1 * | 1/2007 | Mertens et al. | 139/37 |
| 2007/0260352 | A1 * | 11/2007 | Magee et al. | 700/131 |

FOREIGN PATENT DOCUMENTS

| | | |
|---|---|---|
| EP | 0927782 | 8/2002 |

* cited by examiner

METHOD TO AVOID MIXED CONTOURS IN PILE FABRICS

This application claims the benefit of Belgian Patent Application No. 2006/0032, filed Jan. 13, 2006, which is hereby incorporated by reference in its entirety.

BACKGROUND OF THE INVENTION

The present invention relates to a method for detecting colour changes in a card design of the pattern of a fabric which might lead to mixed contours in the fabric, by means of a computer comprising central processing means, bus means, detecting means, data entering means, memory means and displaying means, the data of the card design of the pattern of the fabric being entered through data entering means and a processing programme applying correction lift plans to colour changes in a manner known already.

With face-to-face pile weaving in several colours, each warp system in the fabric will comprise all the colours of the pile warp yarns contained in the fabric. When a pile warp yarn is forming a pile, it will move between the upper and the lower fabric and will be interlaced alternately around a weft in each of the said fabrics. When the pile warp yarn is not forming a pile (dead pile), then it will be interlaced in the backing fabric of one of the two fabrics, the pile warp yarns being distributed among the upper and the lower fabric to be interlaced as a dead pile.

In order to obtain an optimal supply of pile warp yarns in the fabric, an exact formation of the shed and a clear view for the workmen replacing and supplying the bobbins of pile warp yarns in the weaving creel, in the weaving creel containing the bobbins of pile warp yarns and from where the pile warp yarns are supplied to the weaving machine, the pile warp yarns being interlaced in the upper fabric are provided at the top of the weaving creel and the pile warp yarns to be interlaced in the lower fabric are provided at the bottom of the weaving creel.

It is known that in pile fabrics, in certain cases, mixed contours or double acting pile warp yarns might occur at a colour change (this being a change of a pile warp yarn forming a pile where a pile warp yarn is no longer forming a pile and is interlaced as a dead pile in the fabric to which it belongs, whereas another pile warp yarn, from its interlaced situation as a dead pile is starting to form a pile in the fabric to which it belongs).

The occurrence of mixed contours means that two tufts of a different pile frame or of a different colour are crossing one another in the face-to-face fabric between two successive wefts in a fabric. Because no weft is separating the two tufts, the two tufts of a different colour have a strong tendency to take up a wrong position with respect to one another (which means that they will not rest against the adjacent tufts of the same colour, but will be situated between the tufts of a different colour) and this will produce a blurred pattern of the fabric.

A double acting pile warp yarn occurring, means that, between two successive wefts in a fabric, there will be found two tufts of a different pile frame or of a different colour running next to one another without crossing one another. In principle, such tufts situated next to one another are taking up a right position however with respect to the formation of the colour, but this position is not very well secured, due to which both tufts may easily change positions which, in turn, will cause the pattern of the fabric to become blurred.

These double acting pile warp yarns will likewise cause the fabric to become locally more closely woven, as locally, the number of tufts will be double the normal number.

Mixed contours occur depending on:

- the weave structure (single, double, triple gripper weave structures in combination with the type of weave);
- from which fabric the pile warp yarn interlaced starting to form a pile is originating;
- in which fabric the pile warp yarn, no longer forming a pile, will be interlaced;
- in other words on the position of the pile warp yarns in the weaving creel, since the position of the pile warp yarns in the weaving creel is related to the fabric in which the pile warp yarn will be interlaced as a dead pile.

In the table below, some examples are shown of situations in which mixed contours (MC) or double acting pile warp yarns (DW) are occurring. The designation (0) means that neither mixed contours nor double acting pile warp yarns are occurring. When designating the colour changes (BT-BT; BT-OT; OT-OT and OT-OT), the first designation is designating the fabric in which the pile warp yarn stops to form a pile is interlaced as a dead pile and the second designation is designating the fabric from which the pile warp yarn starting to form the pile is originating. (BT stands for upper fabric (upper carpet), OT stands for lower fabric (lower carpet).

| Weave structure | BT—BT | BT-OT | OT—OT | OT-BT |
|---|---|---|---|---|
| single gripper 1/1 V | 0 | 0 | 0 | 0 |
| double gripper ½ V | MC | 0 | MC | MC |
| double gripper 1/1 V | 0 | DW | 0 | 0 |
| three gripper ⅔ V | 0 | DW | 0 | 0 |
| three gripper 2/2 V | 0 | DW | 0 | 0 |
| three gripper 1 + ⅔ V | 0 | DW | 0 | 0 |

In the following part of this patent application mention will only be made of mixed contours where, each time, both mixed contours and double acting pile warp yarns are meant.

Such mixed contour effects may be avoided by respecting a number of designing rules. Thus, a designing rule for ½V weaves is stating that in the card design, at a colour change in which two colours are involved, at least one of the two colours should be present along two lines of the same colour (the same pile frame) in the warp direction. In this manner it will be possible to use the method described in the European patent publication EP 927782 and in which of at least one of the pile warp yarns involved in the colour change, one double lift plan before the pile change or one double lift plan after the pile change is replaced by correction lift plans. For in this correction lift plan one colour point is omitted. When this occurs so that the colour point that is omitted is from the colour of which two lines, and therefore two points, are situated one after the other in the warp direction, still one colour point will remain after having applied the correction lift plan.

In practice, such correction lift plans may be applied automatically in the processing software converting the card design (pattern) into a file serving as an input to activate the Jacquard machine.

However, in order to apply this method, as designated, a number of designing rules have to be observed when producing the card design (the pattern). The correction lift plan is only applicable to produce the effect expected when, during two successive lift plans (successive in the warp direction) the pile is formed by the same pile warp yarn. In practice we find that these designing rules are not always applied, so that even when the correction lift plans are automatically applied by the processing software converting the card design into a file serving as an input to activate the Jacquard machine, mixed contours are still occurring.

The designer of the card design does not sufficiently realize when mixed contours are occurring and what is causing them, because possibly he is not sufficiently aware of the rules for designing and the effects caused by not applying them, but mostly because it is not clear to him why these effects are occurring in one situation and not in another situation (more especially, because the final position of pile warp yarns in the weaving creel as well as the weave structure are not known to him).

The persons in the manufacturing department who are carrying out the processing, selecting the texture of the fabric and selecting the Jacquard machine with the accessory weaving creel are unable to take action to adapt the card design where necessary or dare to interfere only slightly, so that mixed contours will continue to occur.

In many cases, mixed contours are only eliminated, when the quality of the pattern of the fabric produced will be affected too strongly. In practice, in many cases the assistance of the supplier of the Jacquard machine or of the processing software will be requested in order to remedy the effects.

This means, however, that products of an inferior quality with a blurred pattern are produced and in some cases the product even has to be rejected, before corrections are finally made. Furthermore, these interventions by the suppliers will cause a waste of time and additional costs.

SUMMARY OF THE INVENTION

The purpose of the present invention is to define a method offering assistance during the manufacturing process of the pile fabrics in accordance with card designs produced before or during a file being processed to activate the Jacquard machine in order to avoid mixed contours.

The purpose of the invention is attained by providing a method for detecting colour changes which might be the cause of mixed contours in a card design of the pattern of a fabric, by means of a computer comprising central processing means, bus means, detecting means, data entering means, memory means and display image means, wherein the data of the card design of the pattern of the fabric being entered by the data entering means and a processing programme applying correction lift plans to colour changes in a manner known already, the colour changes in the card design being detected by means of the detecting means based on the data entered through the data entering means and colour changes being designated by means of the display image means where a mixed contour is occurring in the fabric, impossible to be avoided by correction lift plans.

Preferably, the data entered are the card design of the pattern of the fabric, the selected weave structure and the position of the pile frames in the weaving creel of the Jacquard weaving machine on which the fabric will be woven.

The data of the card design of the pattern of the fabric, the weave structure and the position of the creel may be contained in the computer or they may be entered by means of any data entering means known, such as manual input, loading through a network or other possible connections from the machine, from a CAD-system, from another computer, from a data carrier (diskette, CD-rom, USB-stick, etc).

Furthermore, the method according to the invention consists in screening the card design by means of a computer (programme) in combination with the data about the actual position of the pile frames in the creel of the Jacquard weaving machine on which the fabric will be woven and in combination with the data about the weave structure which will be applied, for a correct application of the designing rules which should enable correction lift plans to be applied where a mixed contour will occur in the manner known by the state-of-the-art, examples of which are described in EP 0927782, before converting the card design of the pattern of the fabric into a file to activate the Jacquard machine on which the fabric containing the said pattern will be woven.

As an output by means of display image means, the method produces designations in the card design where a mixed contour is occurring impossible to be avoided by means of a correction lift plan. This may be done, for instance, by causing pixels to become fluorescent or to start flashing in the card design, by marking the area by means of a line or a circle or by any other means of display.

This should yet enable the user, before converting the card design into a file to activate the Jacquard machine, to adapt the card design to the designing rules, so that correction lift plans may still be used in order to avoid any mixed contours. This method has the advantage that, before the fabric is actually woven, it will be clearly visible whether mixed contours will occur, and that even before the weaving process has started, it will be possible to take action in order to avoid these mixed contours by adapting the card design. Hence, producing fabrics of an inferior quality or rejection will be avoided.

Furthermore, this method has the advantage that only those mixed contours are compensated typical of the actual position of the pile frames in the weaving creel in combination with the weave structure actually applied.

In a preferred method according to the invention, the computer may be set up in such a manner that only colour changes liable to be the cause of a mixed contour and for which a correction by means of a correction lift plan is not possible, a certain minimum number of which are extending next to one another, are designated. In practice, one single isolated mixed contour in a fabric will not always be noticed and moreover, certain drawings (patterns, designs) are aiming indeed at the fact that different pile warp yarns will form a cloud of points of different colours, the mixed contours intensifying the effect desired. The minimum number of colour changes situated next to one another showing mixed contours impossible to correct by means of a correction lift plan and where it is decided to maintain the mixed contour for smaller numbers of colour changes situated next to one another, may be adjusted by the user of the computer programme carrying out the method.

In its simplest form, colour changes, lying next to one another in the weft direction, will be considered in this case. Since the error created by mixed contours is more pronounced in the warp direction and the warp direction is at right angles to the weft direction, the colour changes in the card design, which in the weft direction are situated next to one another and to which it is impossible to apply any correction lift plans in order to avoid mixed contours, will be found to be most distinctive as being a deviation with respect to the pattern desired of the woven product. When the user is adapting these colour changes in the card design in accordance with the designing rules, this will be the most efficient contribution to an improvement of the quality.

In a more perfect method the minimum number of colour changes situated next to one another liable to cause mixed contours, not possible to be avoided by means of correction lift plans, may be situated in a straight line in any direction and in yet another preferred method, even connected may show any line, the straight or any line, each time having to comprise a minimum number of points, adjusted by the user to be designated as a point or an area in which mixed contours will occur after having applied the processing programme in order to avoid mixed contours by means of correction lift plans. Determining these straight lines running in any direction and lines having any possible shape may occur, for instance, by vectorizing the card design.

It may be obvious that, when the user is adjusting to one the number of points situated next to one another showing mixed contours without possibility of compensation by means of correction lift plans, the computer programme carrying out the method according to the invention, will inform the user of all points in the fabric where a mixed contour will occur.

In a further preferred method according to the invention, the computer programme does not only designate the colour changes or the set of colour changes where mixed contours will occur but, as part of the designation, the computer programme will designate, per colour change or set of colour changes, where mixed contours will occur, one or several suggestions in order to correct the card design to avoid the mixed contours. Then, the user has the possibility to select one of the suggestions made to be validated or to select himself another adaptation of the card design or to maintain the actual version of the card design.

In yet a further preferred method, for part of or all the colour changes detected, the computer programme will carry out automatic corrections of the card design in order to avoid an occurrence of mixed contours.

To select the suggestions for adapting the card design in order to be able to avoid mixed contours by applying correction lift plans, the computer programme has to form a picture of the figure elements in the card design to which the points of the card design belong which are situated in the warp direction on both sides of the colour change, where it is impossible to remove a mixed contour by means of correction lift plans. In order to locate these figure elements in the card design, preferably part of the figure or the entire figure is vectorized.

The card design is a grid design, defining a grid of points, the axes of the grid corresponding to the warp and weft directions. In the grid, a colour is assigned to each point. By locating points in the grid design situated near the edge of colour changes and by keeping in mind the direction between successive points, part of the grid design is vectorized so that it will be possible to recognize the figures in the card design.

This vectorized information may be noted down in a separate layer of the design.

It is also possible to vectorize the entire card design.

In this case, in this vectorized information, the selection is made which form of the pattern is most suitable to be adapted in order to avoid mixed contours in accordance with a decision logic laid down in a computer programme and the adaptation of the form of the pattern will be carried out in the vectorized information. Then the programme will convert the vectorized information into grid information. The method will be able either to confirm this adaptation immediately or to ask the user for approval still, before carrying out the adaptation. In case of the user's approval, the process will be continued using the adapted grid design in order to eliminate any further mixed contours which are impossible to avoid by means of correction lift plans, by adapting the card design. When the complete card design of the pattern of the fabric, in accordance with the invention has been passed through, the processing programme is started, the adapted card design being converted into a file suitable to activate the Jacquard machine.

Therefore, by means of the vectorized information (position and direction), the form of the pattern may be deducted from the elements of the pattern and the necessary information is available to adapt the entire form of the pattern by means of the computer programme in order to avoid mixed contours, allowing the form of the pattern to maintain certain characteristics because of the adaptation (for instance, a circular form may be adapted to a new circular form with a corrected radius). Hereby the information about the direction is important when at a certain point or in a certain area of the circular form a number of points have to be added in order to avoid a mixed contour in the card design by applying correction lift plans to adapt the complete form of the pattern in order to maintain essential characteristics of the form of the pattern (for instance, the circular form, . . . ).

Other specific and advantageous methods for detecting colour changes according to this invention are described in the dependent claims.

BRIEF DESCRIPTION OF THE DRAWINGS

The FIGS. 1, 2, 3 and 4 represent the method and steps according to the invention in block diagrams

DETAILED DESCRIPTION OF THE PREFERRED EMBODIMENTS

Figure 1:
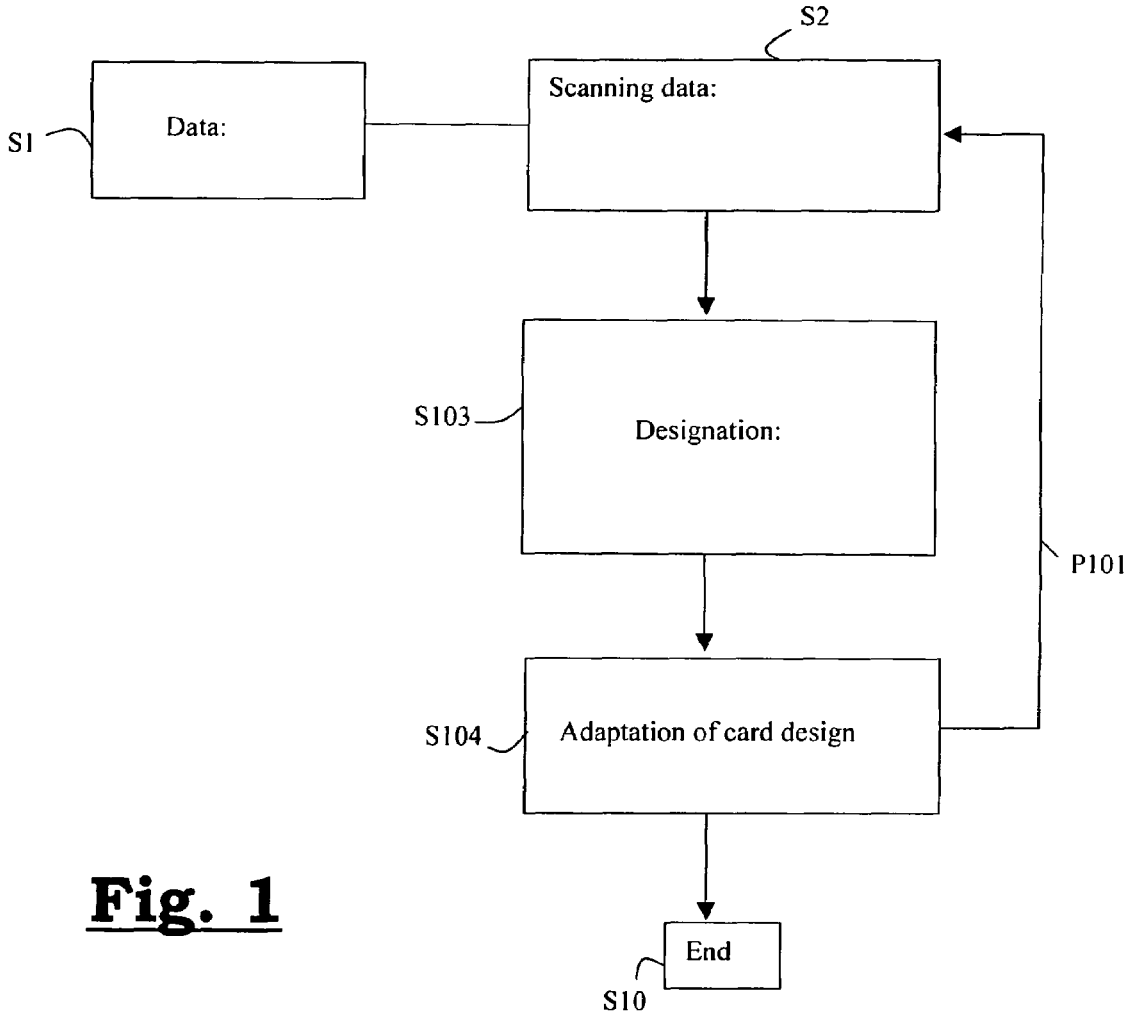

As represented in FIG. 1, in step S1, the data entered are the card design of the pattern of the fabric, the texture of fabric selected and the position of the pile frames in the creel of the Jacquard weaving machine on which the fabric will be woven. In step S2, the entered data are scanned for colour changes causing mixed contours impossible to avoid by means of a correction lift plan. The method produces designations (S103) in the card design where a mixed contour is occurring impossible to be avoided by means of correction lift plans. Subsequently, the card design will be adapted (S104) in order to avoid mixed contours by creating possibility to apply correction lift plans. As long as the card design is not completely passed through, the loop P101 is completed.

Figure 2:
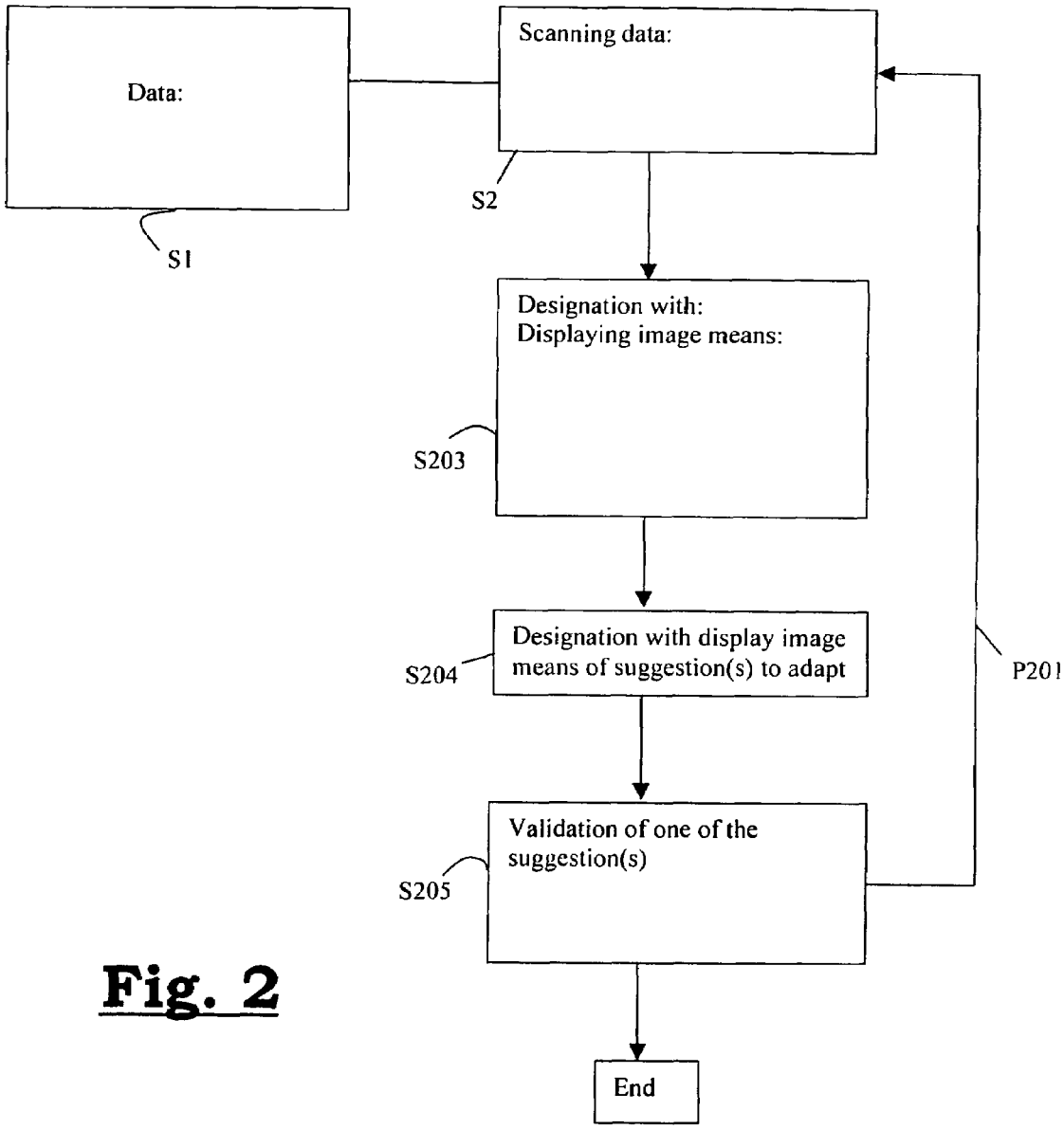

FIG. 2 represents also S1 and S2. According to FIG. 2, the method designates and displays colour changes or areas with colour changes where occurring of mixed contours are impossible to avoid by means of correction lift plans (S203), and also designates and displays one or several suggestions (S204) in order to correct the card design to avoid the mixed contours. Then, the user has the possibility to select one of the suggestions to be validated or to select himself another adaptation of the card design or to maintain the actual version of the card design (S205). As long as the card design is not completely passed through, the loop P201 is completed.

Figure 3:
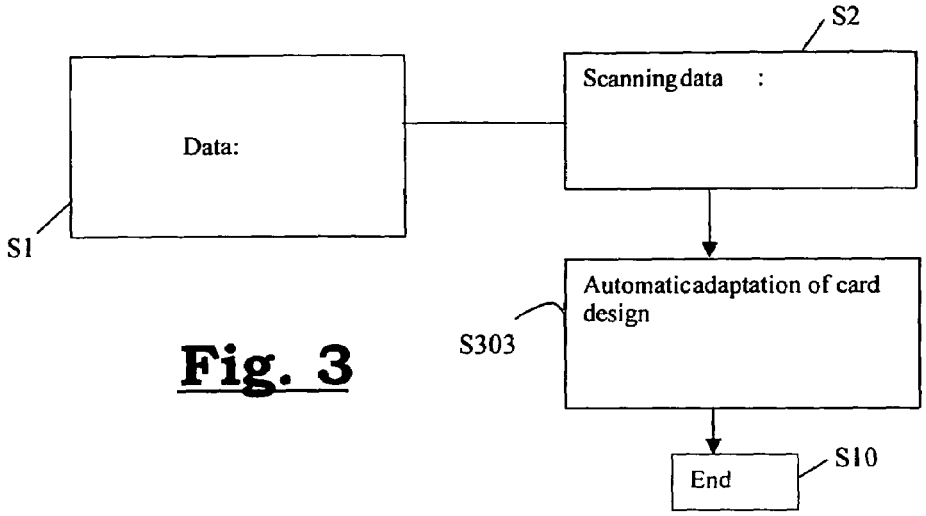

FIG. 3 represents also S1 and S2. According to FIG. 3, the method automatically adapts the card design due to which mixed contours may be avoided by applying correction lift plans.

Figure 4:
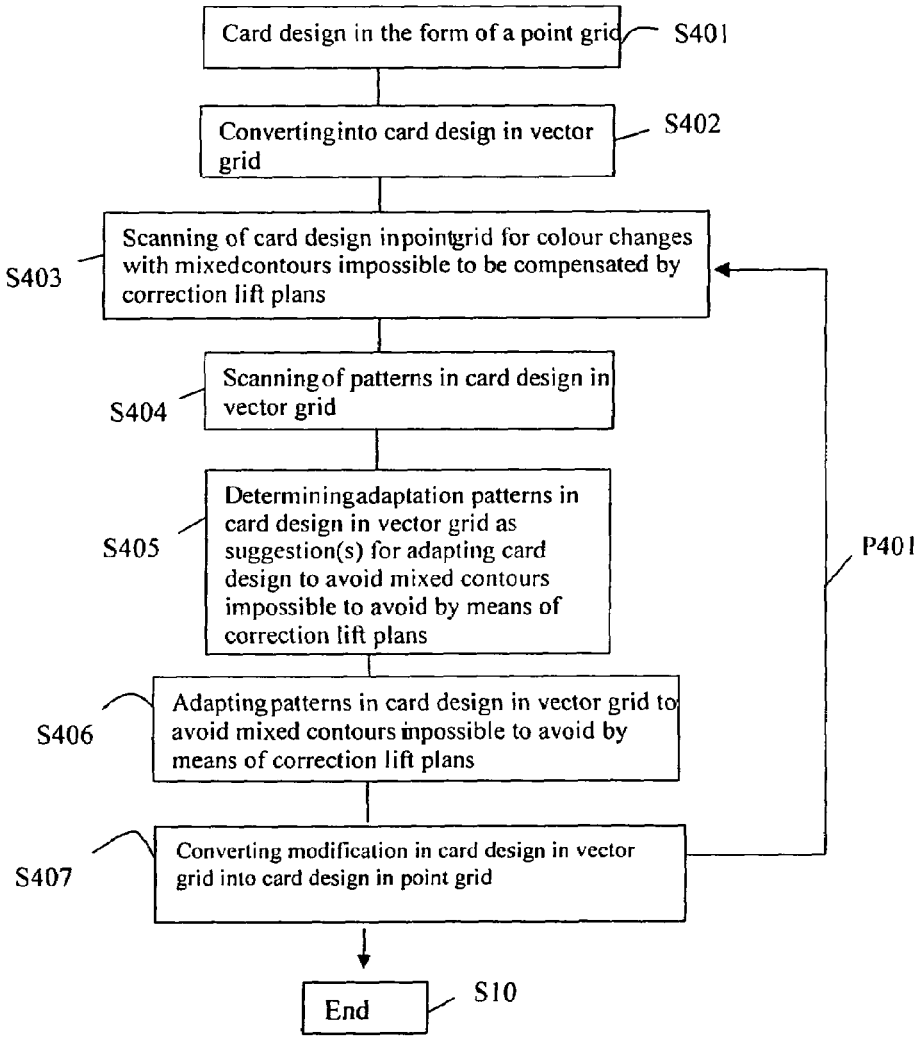

As represented in FIG. 4 the card design is a grid design, defining a grid of points (S401), the axes of the grid corresponding to the warp and weft directions. In the grid, a colour is assigned to each point. By locating points in the grid design situated near the edge of colour changes and by keeping in mind the direction between successive points, part of the grid design is vectorized (as is expressed in step S402) so that it will be possible to recognize the figures in the card design. In step S403, card design in point grid is scanned for colour changes with mixed contours impossible to be compensated by correction lift plans. When a colour change with mixed contour impossible to compensate by correction lift plan is detected a step 404 starts, in which the card design in vector grid is scanned from the detected point of problematic colour change out to detect the figure line in the card design to which the point of problematic colour change belongs. Step 405 determining, using the information on the figure lines detected in step 404, adaptation patterns in card design in vector grid as suggestion(s) for adapting card design to avoid mixed contours impossible to avoid by means of correction lift plans. The method will be able either to confirm this adaptation immediately or to ask the user for approval still, before carrying out the adaptation. In case of the user's approval, the process will be continued (step 406) using the adapted grid design in order to eliminate any further mixed contours which are impossible to avoid by means of correction lift plans, by adapting the card design. After converting this modification from card design in vector grid into card design in point grid (step 407), step 403 to S407 is repeated until the complete card design of the pattern of the fabric, in accordance with the invention has been passed through. After this the processing programme is started, the adapted card design being converted into a file suitable to activate the Jacquard machine.

Figure 5:
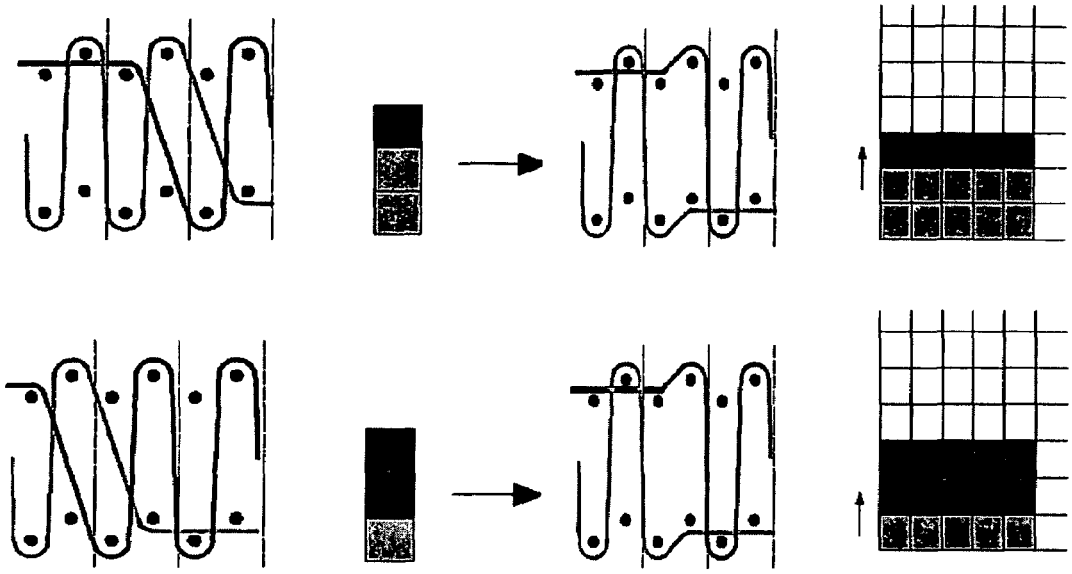
FIG. 5 shows mixed contours and corrected color changes.

During processing (converting the card design into a file to activate the Jacquard controller) correction lift plans are applied wherever possible, as represented in FIG. 5. Here, in a ½V weave structure, in a double rapier technique a pile warp change (colour change) is represented of a first pile-forming pile warp yarn being interlaced as a dead pile in the lower fabric towards a second pile-forming pile warp yarn being interlaced in the upper fabric as a dead pile.

In the representation "before" a correction lift plan is applied, it will be noticed that a mixed contour will occur.

"After" the correction lift plan has been applied, the mixed contour has been avoided, but an entire pile tuft (two tufts) of the first pile warp yarn has been lost. In the lower fabric of the same part of the pattern, however, the same amount of pile tufts and tufts are maintained.

In the lower part of the pattern, in the lower fabric an entire pile tuft (two tufts) of the second pile warp yarn has been lost, whereas in the upper fabric of the same part of the pattern all pile tufts and tufts remain.

This means, that in case the correction lift plans would have been applied to a part of the card design in which, in the warp direction, two or several single colour lines are occurring successively (one line of a certain colour followed by a line of a different colour, possibly again followed by a line of a different colour) here at least one colour line would disappear in one of the fabrics, which is unacceptable with respect to the design aimed at during the weaving process.

Therefore, normally the processing programme of the processing software will not apply these correction lift plans in cases in which a certain colour should disappear in one of the two fabrics after the correction lift plans having been applied, so that a mixed contour will definitely not occur during the weaving process.

It is indeed possible to avoid such an imperfection by adapting the card design, so that, at each colour change, at least one of the colours involved in the colour change will be present across two colour lines. Then the processing programme within the processing software will select these correction lift plans, the pile tuft having been lost, being a pile tuft of a colour of which there are two colour lines in the card design, so that in both fabrics at least one of both colour lines will be maintained as a pile tuft.

The invention claimed is:

1. A method for offering assistance before or during manufacture of pile fabrics in accordance with card designs produced before or during a file being processed to activate a Jacquard machine, the method comprising using a computer having an input, a central processor, and a display, inputting data from a card design for a fabric pattern, on the basis of the data entered, detecting in the card design color changes that might cause mixed contours in the fabric to be woven by the Jacquard machine, designating in the processor the color changes in the card design that might cause mixed contours in the fabric to be woven by the Jacquard machine, and displaying the designated color changes where a mixed contour occurring in the fabric may be impossible to avoid by a correction lift plan.

2. Method according to claim 1, characterized in that the said data entered are:

the card design of the pattern of the fabric, a weave structure selected and a position of pile frames in a creel of a Jacquard weaving machine on which the fabric will be woven.

3. Method according to claim 1, characterized in that the card design is screened for a correct application of designing rules which should enable correction lift plans to be applied where a mixed contour will occur, before converting the card design of the pattern of the fabric into a file to activate a Jacquard weaving machine on which the fabric containing the said pattern will be woven.

4. Method according to claim 3, characterized in that the method produces as an output designating in the card design where a mixed contour occurring is impossible to be avoided by a correction lift plan.

5. Method according to claim 4, characterized in that the computer is set up in such a manner that only colour changes liable to be the cause of a mixed contour and for which a correction by a correction lift plan is not possible are designated.

6. Method according to claim 3, characterized in that a computer programme designates per colour change or set of colour changes, where mixed contours will occur, one or several suggestions in order to correct the card design to avoid the mixed contours.

7. Method according to claim 3, characterized in that a computer programme carries out automatically corrections of the card design.

8. Method according to claim 1, characterized in that gridded information on the card design is vectorized information.

9. Method according to claim 8, characterized in that vectorized information is displayed in separate layers.

10. Method according to claim 8, characterized in that vectorized information which has been corrected is converted into gridded information.

11. A method comprising offering assistance during the manufacture of pile fabrics in accordance with card designs produced before or during a file being processed to activate a Jacquard machine:

providing a card design for use in a Jacquard machine;

screening the card design with a computer;

determining color changes causing mixed contours in the card design that are impossible to be compensated for and avoided by correction lift plans, and designating the determined color changes on a display of the computer.

12. Method of claim 11 further comprising displaying one or several suggestions for correcting the card design to avoid the determined color changes.

13. Method of claim 12 further comprising adapting the card design with the computer for avoiding the mixed contours, and displaying the adapted card design.

14. The method of claim 12 further comprising automatically applying the adapted card design for use in the Jacquard machine.

15. A method comprising offering assistance during the manufacture of pile fabrics in accordance with card designs produced before or during a file being processed to activate a Jacquard machine for preventing color changes in a card design causing mixed contours in face to face woven fabrics:

screening with a computer the card design from the Jacquard machine color changes likely to cause the mixed contours;

determining the color changes that are likely to caused mixed contours; and designating and displaying on a display of the computer the color changes likely to cause the mixed contours that cannot be avoided.

16. The method of claim 15 further comprising displaying on the display one or several suggestions for correcting the card design to avoid the mixed contours.

17. The method of claim 16 further comprising automatically applying one of the suggestions of correction to the card design to avoid the mixed contours.

18. A method for offering assistance during the manufacture of pile fabrics in accordance with card designs produced before or during a file being processed to activate a Jacquard machine, the method comprising avoiding mixed contours in color changes in a fabric to be woven in a Jacquard loom, providing a card design controlling color changes in the fabric to be woven in the Jacquard weaving machine, providing a computer with a processor, an input and a display, providing a program in the computer to detect and designate color changes that will produce mixed contours in the fabric from a card design entering the card design of the pattern of the fabric in the input of the computer, detecting locations and designating points in the card design where the mixed contour will occur, displaying with the display the location of points in the card design where the mixed contours will occur.

19. The method of claim 18, further comprising providing suggestions to correct the card design to avoid the mixed contours and displaying the suggestions.

20. The method of claim 19, further comprising selecting one of the suggestions.

21. The method of claim 18, further comprising carrying out in the programmed computer correction of the card design to avoid the mixed contours.

22. The method of claim 18, further comprising entering in the computer a weave structure of the fabric to be woven and positions of pile frames in a creel of the Jacquard weaving machine.

23. A method for offering assistance during the manufacture of pile fabrics in accordance with card designs produced before or during a file being processed to activate a Jacquard machine, the method comprising avoiding mixed contours in a pile fabric to be woven in a Jacquard weaving machine by providing a computer, providing a program for detecting in a card design color changes that will produce mixed contours, entering data of the card design of a pattern of the fabric, entering data of a planned weave structure of the fabric, entering data of positions of pile frames in a creel of the Jacquard machine, scanning the entered data for color changes causing mixed contours designating the color changes causing mixed contours, and displaying the color changes causing mixed contours.

24. The method of claim 23, further comprising adapting the card design to avoid the designated color changes causing mixed contours.

25. The method of claim 23, further comprising designating and displaying a suggestion or suggestions for color changes causing mixed contours.

26. The method of claim 25, further comprising validating the suggestion or one of the suggestions.

27. The method of claim 23, further comprising providing the card design in a form of a point grid, converting the point grid of the card design to a vector grid, scanning the card design in the point grid for color changes causing mixed contours, scanning the card design in the vector grid, determining adapting patterns in the card design in the vector grid as a suggestion or suggestions, modifying patterns in the card design in the vector grid to avoid mixed contours, and converting the modifying of patterns of the card design in the vector grid to modifying the card design in the point grid.

* * * * *